United States Patent [19]

Atchisson

[11] 4,027,389

[45] June 7, 1977

[54] MULTIPLE BLADE FOLDABLE THROWING KNIFE

[76] Inventor: Maxwell G. Atchisson, 55 Old Yellow Springs Road, Apt. H, Fairborn, Ohio 45324

[22] Filed: May 24, 1976

[21] Appl. No.: 689,577

[52] U.S. Cl. ..... 30/303; 273/106 R

[51] Int. Cl.[2] ..... B26B 1/04; A63B 65/00

[58] Field of Search ..... 273/106 R, 106 D; 46/82; 30/303, 347; 56/295

[56] References Cited

UNITED STATES PATENTS

| | | | |
|---|---|---|---|
| 2,361,988 | 11/1944 | Bonnifield | 273/106 D |
| 2,714,509 | 8/1955 | Ramsey | 273/106 R |
| 3,507,497 | 4/1970 | Gardner | 273/106 D |

*Primary Examiner*—Al Lawrence Smith
*Assistant Examiner*—J. C. Peters

[57] ABSTRACT

A throwing knife having a multiple number of pointed blades for hitting a target, and being readily foldable so as to be carried conveniently when not in use. Each blade has a number of locking studs on one side of the blade, and a corresponding number of mating locking dimples on the other side of the blade. The blades are pivotally mounted on an axle about which the blades can be rotated either to the folded position with all blades stacked one above the other, or to the throwing position wherein the blades radiate outwardly from the axle. The studs and complementary dimples of adjacent blades engage one another in the folded and the throwing positions so as to secure the knife in such positions.

6 Claims, 6 Drawing Figures

MULTIPLE BLADE FOLDABLE THROWING KNIFE

This invention relates in general to knives and in particular to knives especially intended for throwing.

Those persons skilled in the use of knives will realize that a substantial amount of skill and expertise is necessary in throwing a knife at an object. A thrown knife must obviously arrive point-forward at the target, after executing at least a half-turn in the air upon leaving the thrower's hand. This feat becomes more difficult as one attempts to hit targets at variable distances from the thrower, since the turning speed and the number of turns which the knife must make in the air have to be estimated and correctly accomplished after visually gaging the distance from the thrower to the target.

It has been proposed to provide knives designed especially for throwing, with such knives having a plurality of blades extending outwardly from a central hub to form a star-like array of blades. Such multiple blade throwing knives are held by one blade while throwing, and the entire array of blades rotates while moving toward the target with the result that one of the blades usually arrives nearly point-forward at the target. Such multiple blade throwing knives of the prior art have been constructed to remain partially or fully in throwing configuration at all times, however, and so such knives are relatively awkward or dangerous to carry or store when not in use.

Accordingly, it is an object of the present invention to provide an improved multiple blade throwing knife.

It is another object of the present invention ot provide a multiple blade throwing knive which can be fully folded when not in use.

It is yet another object of the present invention to provide a multiple-blade foldable throwing knife in which each separate blade may be identical for ease of manufacture and construction.

Stated ingeneral terms, the multiple blade throwing knife of the present invention includes a number of separate blades each having a pointed forward end and a back end. The blades are interconnected adjacent their back ends for pivotable movement about an axis which is perpendicular to the blades, and each blade contains locking structure which is complementary to locking structure on the other blades so that the blades can be interlocked either in a throwing position or in a folded position. When folded, the several blades are stacked together with all pointed edns aligned, so that the pointed ends of the folded knife can be readily placed in a holster or similar protective device. Stated more specifically, the locking structure of each blade is provided by a number of projections extending outwardly from one side, and by a corresponding number of recesses formed inwardly into the other side in alignment with the projections. The projections and recesses on each blade are arranged so that the projections and confronting recesses on adjacent blades are interlocked with each other in a complementary manner whenever the blades are either in folded position or in throwing position, so that the blades are locked together in either such position.

The multiple blade foldable throwing knife of the present inventon is better understood with reference to the disclosed embodiment thereof, as shown in the drawings in which.

Figure 1:
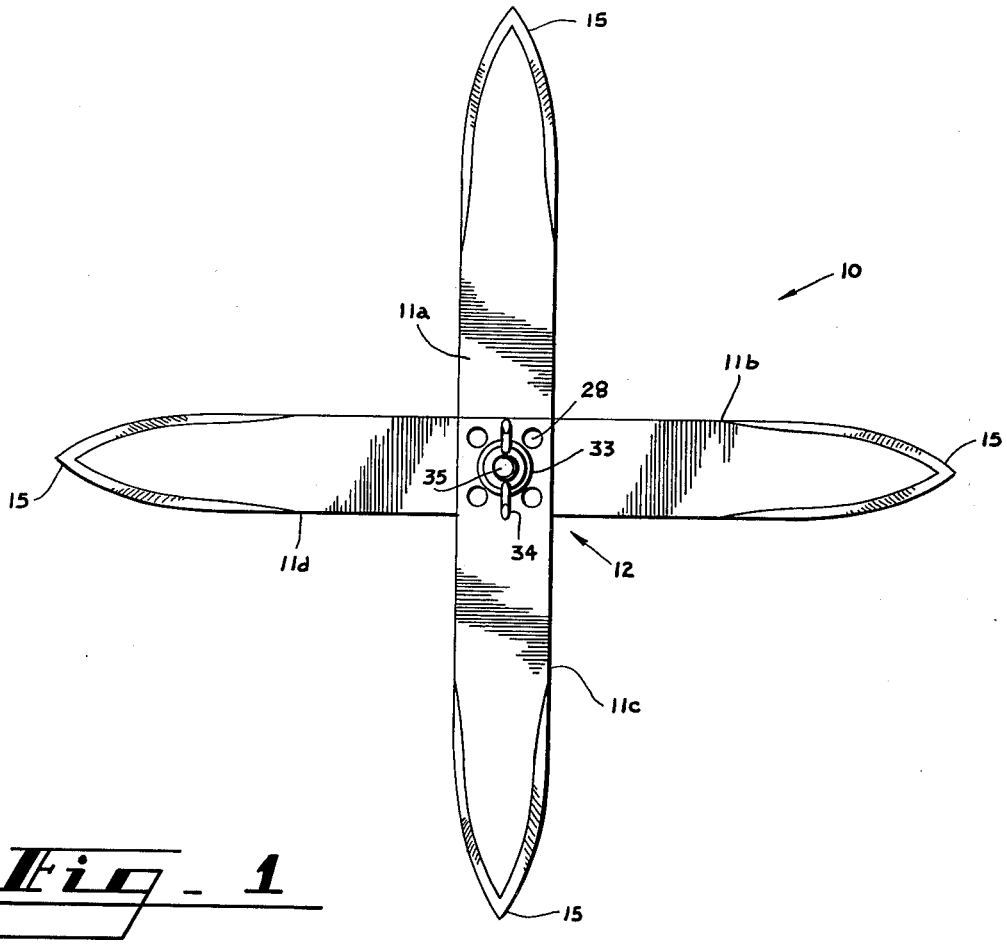
FIg. 1 shows a plan view of a disclosed embodiment of the present knife, in throwing configuraton.

Turning to FIG. 1, there is shown generally at 10 a multiple balde foldable throwing knife according to the present invention. The knife 10 has four separate blades 11*a*, 11*b*, 11*c*, 11*d*, although it will be apparent that the use of four blades is not a critical aspect of the present invention. The four-blade throwing knife 10 is shown in its throwing configuration in FIG. 1, and the knife presents four pointed ends extending radially outwardly in symmetrical array from the central portion 12 of the unfolded throwing knife.

Figure 2:
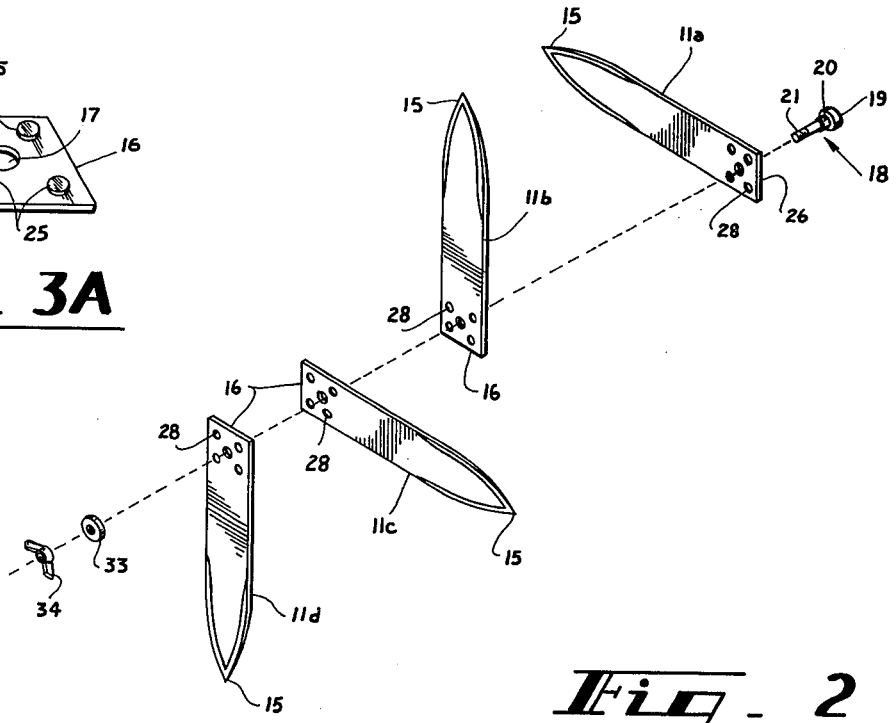
FIg. 2 shows an exploded view of the throwing knife of FIG. 1.

FIG. 2 shows the knife 10 in exploded view of the throwing configuration. Each of the blades 11*a*–11*d* is preferably identical according to the present invention, and so the following detailed description of blade 11*a* is equally applicable to all such blades. The blade 11*a*, as best seen in FIG. 3, has a pointed forward end 15 and a blunt back end 16 which may be perpendicular to the longitudinal axis of the blade. An opening 17 extends through the blade 11*a* a short distance away from the back end 16, and an axle 18 extends through the openings 17 in each of the four blades.

Figure 5:
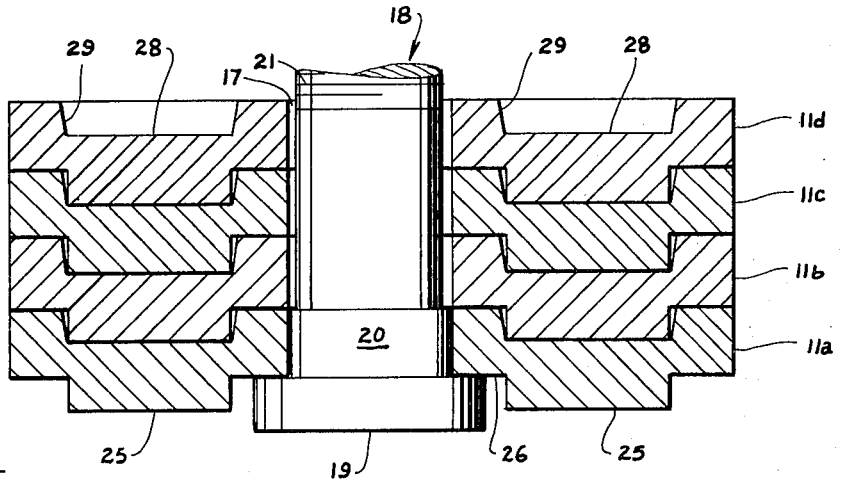
FIG. 5 is a partially broken-away vertical section view taken along 5—5 of FIG. 4.

The axle 18, as best seen in FIGS. 2 and 5, has a head 19 which is larger than the opening 17 and which abuts the first side 26 of the lowermost blade 11*a*. Adjacent the head 19 of the axle 18 is a shank portion 20 having longitudinal extent which is slightly less than the thickness of the blade 11*a*, and which is dimensioned to provide an interference fit with the hole 17 of that blade (or with the corresponding hole in any of the identical blades). The remaining length of the axle 18, including the threaded outer portion 21, is less than the diameter of each opening 17 so that the blades 11*b*, 11*c*, and 11*d* are pivotably received on the axle as best shown in FIG. 5.

Figure 3A:
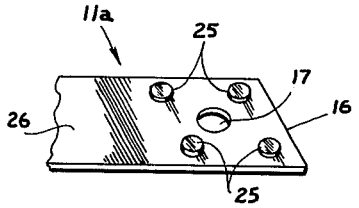
FIG. 3A is a fragmentary bottom plan view of the blade shown in FIG. 3.
Figure 3:
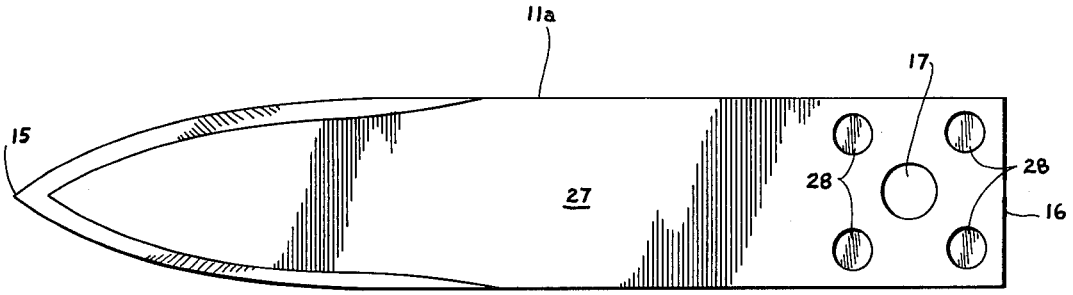
FIG. 3 is a top plan view of a typical blade contained in the knife of FIG. 1.

Turning to FIGS. 3A and 5, it is seen that blade 11*a* (and each other blade) has four studs 25 projecting outwardly a distance from the first side 26 of the blade. The studs 25 are substantially identical in configuration and are symmetrically positioned with respect to the opening 17 in the blade.

On the second side 27 of each blade are formed four dimples 28 each of which is coaxially aligned with a corresponding stud 25 on the first side 26 of the blade. The dimples 28 are of complementary configuration to the studs 25, so that the array of studs 25 of one blade will mate with the array of dimples 28 of another identical balde, as shown in FIG. 5. The interlocking configuraton of studs and dimples permits any two adjacent blades to be locked into any of four positions 90° apart from each other. As best seen in FIG. 5, the wall 29 of each dimple 28 is tapered outwardly to allow a snug yet readily desengageable fit between dimples and adjacent studs, within practicable manufacturing tolerances.

The depicted knife 10 is assembled by initially inserting the axle 18 into the opening 17 of the blade 11*a* and pressing the interference-fit shank portion 20 into that opening until the head 19 of the axle is flush against the first side 26 of the blade 11*a*. The remaining three blades 11*b*, 11*c*, and 11*d* are then placed on the axle 18 which extends outwardly from the first side 26 of the blade 11*d*. The dimples of all blades are facing the head 19 of the axle.

A washer 33 is then placed over the threaded outer portion 21 extending outwardly from the blade 11*d*, and the wing nut 34 is threaded onto the threaded outer portion. The outermost end 35 of the threaded outer portion 21 should then be staked or otherwise deformed to prevent the wing nut 34 from becoming removed from the axle thereafter.

Figure 4:
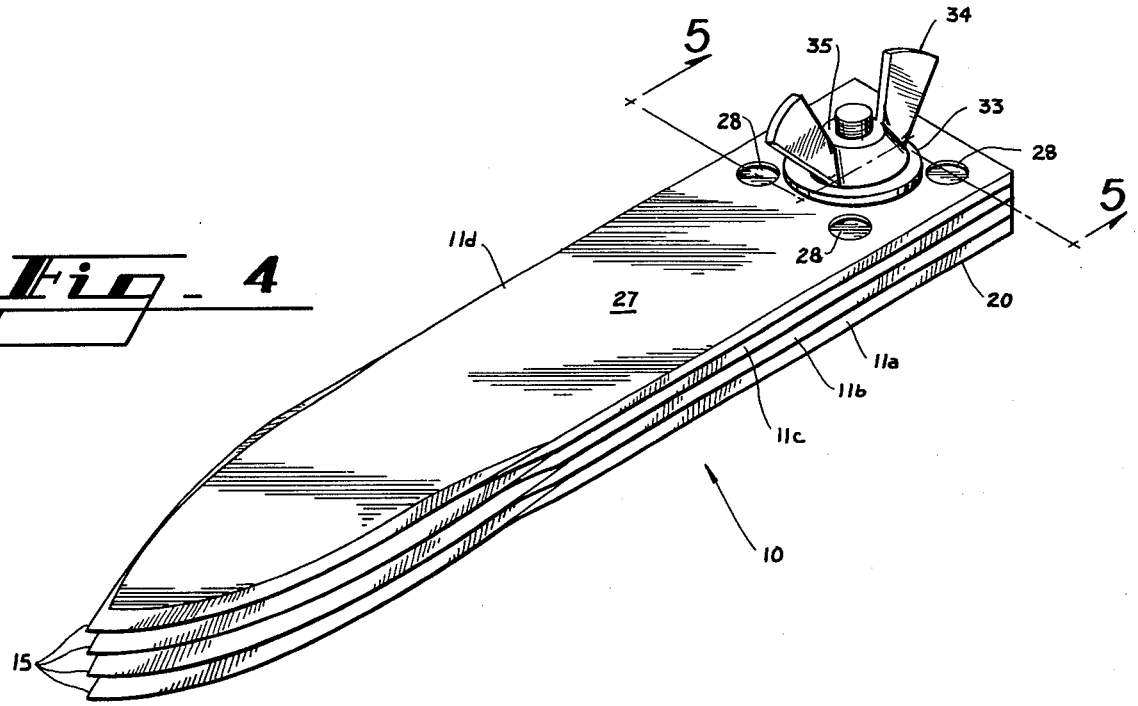
FIG. 4 is a pictorial view showing the disclosed knife in folded configuration.

The knife 10 is normally stored and carried in the folded position shown in FIG. 4, in wich all of the blades are stacked together with the pointed front ends aligned. The blades are locked in the folded position, inasmuch as th studs 25 of blades 11*b*, 11*c*, and 11*d* are within dimples 28 of blades 11*a*, 11*b*, and 11*c*, respectively. It will be apparent that a sheath or similar carrying device can readily be fashioned to receive and guard the aligned pointed ends 15 while the knife 10 is folded as shown in FIG. 4. When it is desired to unfold the knife 10 into throwing configuration, the wing nut 34 is loosened sufficiently to allow the studs 25 of blades 11*b*, 11*c*, and 11*d* to be withdrawn from the mating dimples 28 of the respective adjacent blades. The blades are then rotated until all blades are mutually 90° apart as shown in FIGS. 1 and 2, at which point the dimples and studs are again in locking alignment. The wing nut 24 is once again tightened to retain the locking alignment of the studs and dimples, and the knife 10 is ready to be thrown at a target.

The knife 10 is folded by reversing the foregoing procedure.

It will be seen that there has been disclosed and described a multiple blade foldable throwing knife which is readily placed either in a throwing configuration in which all blades extend radially outwardly from a central portion, or in a folded position in which the knife occupies a minimum volume and the points of the blades are aligned for safety and protectablitiy. The press-fit arrangement of the axle portion 20 within the opening 17 in any one of the blades allows all blades of the knife to be identical, further simplifying the manufacture and assembly procedure. Furthermore, the use of identical blades simplifies the stocking and supply of replacement blades in the event that an individual blade of the throwing knife becomes broken or damaged.

It will be apparent that a throwing knife according to the present invention can be provided with a greater or lesser number of blades than four, with a corresponding adjustment in the number of dimples and studs on each of the blades to permit blade interlocking in either the folded or throwing positions as described above. The number of studs on the first side 26 of each blade, as well as the number of dimples on the second side 27, will each be equal to the multiple number of blades of the knife in any case.

It will be understood that the foregoing relates only to a preferred embodiment of the present invention, and that numerous changes and modifications may be made therein without departing from the spirit and the scope of the invention as set forth in the following claims.

I claim:

1. A multiple blade foldable throwing knife comprising:

a plurality of blades, each of said blades having a pointed distal end and a proximal end;

means interconnecting the proximal ends of each of said blades to selectably permit said blades to pivot about an axis; and complementary engaging means at the proximal ends of each said blade, said engaging means being operative to retain said blades in either a folded position, wherein all said blades are stacked on each other, or in a throwing position, wherein said blades maintain a predetermined angular spacing in radial relation about said interconnecting means;

said engaging means comprising a plurality of projections extending outwardly from the proximal end of each blade on a first side thereof;

a plurality of recesses extending inwardly into each said proximal end on a second side thereof; and said plural projections and plural recesses being of mutually complementary shape and location so that said projections removably enter into said recesses to retain said blades in either of said folded position and said throwing position.

2. A multiple blade foldable throwing knife comprising:

a plurality of blades, each of said blades having a pointed distal end and a proximal end;

means interconnecting the proximal ends of each of said blades to selectably permit said blades to pivot about an axis;

said interconnecting means comprising a hole formed in the distal end of each said blade;

an axle which is secured within said hole of one said blade and which is freely recessed within said holes of the remainder of said blades;

means engaging said axle and operative to selectably clamp together said proximal ends of said blades to maintain said engaging means in either of said folded and throwing positions;

said holes of each of said blades being of equal diameter;

said axle having a portion which is an interference fit within a hole of only said one blade, so as to secure said axle thereto without interfering with rotational movement of the remaining said blades about said axle; and complementary engaging means at the proximal ends of each said blade, said engaging means being operative to retain said blades in either a folded position, wherein all said blades are stacked on each other, or in a throwing position, wherein said blades maintain a predetermined angular spacing in radial relation about said interconnecting means.

3. A multiple blade foldable throwing knife comprising:

a plurality of blades, each of said blades having a pointed distal end and a proximal end;

said proximal end of each said blade including first and second opposed surfaces;

means interconnecting the proximal ends of each of said blades to selectably permit said blades to pivot about an axis;

complementary engaging means at the proximal ends of each said blade, said engaging means being operative to retain said blades in either a folded position, wherein all said blades are stacked on each other, or in a throwing position, wherein said blades maintain a predetermined angular spacing in radial relation about said interconnecting means;

said engaging means comprising a plurality of projections extending outwardly from the first surface of each said blade;

a corresponding pluraliy of recesses extending inwardly into the second surface of each said blade; and each of said projections of any said blade being shaped and located to fit snugly within a corresponding recess on a second surface of any other of said blades.

4. A knife as in claim 3, wherein each of said recesses has a slight amount of outward taper to provide a snug removable fit for said projections.

5. A knife as in claim 3, wherein:

said interconnecting means comprises a hole formed through the distal end of each said blade;

said projections and recesses being symmetrically disposed about said hole in each said blade;

an axle which is secured within said hole of one said blade and which is rotatably received within said holes of the remainder of said blades; and means engaging said axle and oerative to selectably clamp together said proximal ends of said blades to maintain said projections within corresponding recesses of adjacent blades.

6. A knife as in claim 3, wherein;

said projections and recesses are symmetrically disposed about a central location on the proximal end of each said blade; and the number of said projections and the number of said recesses on each blade is each equal to the quantity of said blades in said throwing knife, so that said blades in throwing position are disposed in symmetrical radial relation about said central location.

* * * * *